United States Patent [19]

Hudspeth et al.

[11] Patent Number: 4,539,534

[45] Date of Patent: Sep. 3, 1985

[54] SQUARE CONDUCTOR COAXIAL COUPLER

[75] Inventors: Thomas Hudspeth, Malibu; Richard V. Basil, Jr., Chatsworth; Harmon H. Keeling, Lake Isabella, all of Calif.

[73] Assignee: Hughes Aircraft Company, El Segundo, Calif.

[21] Appl. No.: 468,826

[22] Filed: Feb. 23, 1983

[51] Int. Cl.[3] ..... H01P 5/18

[52] U.S. Cl. ..... 333/115; 333/245

[58] Field of Search ..... 333/115, 116, 111, 123, 333/243, 244, 127, 128, 136, 125, 109, 113

[56] References Cited

U.S. PATENT DOCUMENTS

| | | | |
|---|---|---|---|
| 2,657,361 | 10/1953 | Henning | 333/115 |
| 2,679,632 | 5/1954 | Bellows, Jr. | 333/111 |
| 4,001,730 | 1/1977 | Spinner | 333/111 |

FOREIGN PATENT DOCUMENTS

| | | | |
|---|---|---|---|
| 2016801 | 4/1970 | Fed. Rep. of Germany | 333/116 |
| 557443 | 7/1977 | U.S.S.R. | 333/245 |

*Primary Examiner*—Eugene R. LaRoche
*Assistant Examiner*—Benny T. Lee
*Attorney, Agent, or Firm*—W. J. Benman, Jr.; A. W. Karambelas

[57] ABSTRACT

A hybrid coupler is of the type known as a transverse electromagnetic mode, coupled transmission line coupler. The hybrid coupler is formed within a plate of metal by milling out channels of square cross-sections therein. The walls of the channels serve as outer conductors of coaxial lines, there being inner conductors of square cross-section positioned within the channel. A diagonally disposed window crosses the intersection of the ports and includes a separator. The central conductors of the respective coaxial lines are joined by diagonally disposed segments of inner conductor such that each pair of coaxial lines is so joined. Each pair of lines provides a pair of ports. The line segments are spaced apart by a spring-loaded separator for rigidly maintaining a coupling distance.

9 Claims, 3 Drawing Figures

SQUARE CONDUCTOR COAXIAL COUPLER

BACKGROUND OF THE INVENTION

This invention relates to microwave circuits and, more particularly, to a coupler of electromagnetic energy in a microwave circuit employing coaxial lines of square conducting elements.

Cross-reference is hereby made to three copending applications pertaining to microwave systems assigned to the same assignee; "Coaxial Transmission Line Crossing" invented by T. Hudspeth and H. H. Keeling, Ser. No. 468,827, filed on 23 Feb. 1983; "Ferrite Modulator Assembly For Beacon Tracking System" invented by T. Hudspeth, H. S. Rosen and F. Steinberg, Ser. No. 469,870, filed on 25 Feb. 1983; and "Coaxial Line To Waveguide Adapter" invented by T. Hudspeth and H. H. Keeling, Ser. No. 468,825, filed on 23 Feb. 1983. These applications are hereby incorporated by reference in their entirety.

An important use of microwave circuitry is found in the construction of satellites which orbit the earth to serve as communication links among various stations on the surface of the earth. Such microwave circuits are utilized to receive and retransmit signals between the satellite and the earth station. The microwave circuitry is also utilized in the development of tracking signals for orienting the satellite and for directing the antennas in the requisite direction for communication with the stations. In one form of tracking mode, a beacon signal on the earth is sent to the satellite. The satellite receives the beacon signal by an antenna and a signal processing circuit develops azimuth and elevation error signals by which the satellite is able to correct its orientation. The arithmetic manipulations of the sum channel, the azimuth channel and the elevation channel in producing the orientation error signals are also accomplished by microwave circuitry.

In the construction of a satellite, it is important to construct the microwave circuits with a physical structure that insures their long-term reliability. It is also important to construct the circuits in a fashion that can withstand the forces of liftoff, vibrations, and other sources of physical stress which may be present in a satellite.

A form of construction which has enjoyed much success is the construction of microwave circuits within a solid plate of electrically conducting materials, preferably a light weight metal such as aluminum. The microwave structures are formed, in part, by milling out channels in the surface of the metallic plate for the conduction of electromagnetic signals in a range of, for example, 4–6 GHz (Gigahertz) as well as other bands. A cover plate is then placed on top of the base plate with the milled channels to close off these channels to form the passageways for the propagation of the electromagnetic energy.

One form of physical structure for the electromagnetic passages is the coaxial line formed of an outer conductor of square cross-section, and having an inner conductor, also of square cross-section. Both the inner and outer conductor are formed of metal. This type of structure is advantageous in satellites due to the wide bandwidth, compact size, low propagation loss, and adaptability for distribution networks and for multiple element antenna feeds.

A problem arises in the use of the foregoing square coaxial line in that the components thereof must be carefully fitted in place to insure proper transmission of electromagnetic energy. The components must also be rigidly secured to insure that they do not move from their designated places under the stresses to which a satellite may be subjected. In the past, these mounting requirements have been met by the use of specially fabricated support structures which required more time than is desirable for the insertion and positioning of the support structures within the microwave circuit. In addition, the physical structure did not provide for as good an impedance match or for the coupling of electromagnetic energy over the same spectral band as might be desired.

SUMMARY OF THE INVENTION

The foregoing problem is overcome and other advantages are provided by a structure for the positioning of elements in a hybrid coupler for square conductor coaxial lines. The structure also facilitates the tuning of the coupler and the adjustment of its characteristics to provide for a minimization of variation of coupling as a function of frequency about the center of the spectral band of interest while maintaining a desired level of impedance match over the same spectral band. In particular, both the coupling and impedance characteristics can be optimized for a wide frequency range of interest. The coupler finds ready use in the power division and summation circuits utilized in the development of tracking signals for the orienting of the satellite in accordance with a signal received from a beacon on the earth's surface, and also finds use in multi-element antennas to form, transmit and receive beam patterns for communication. The physical structure of the coupler permits the coupler to be scaled upward in frequency over a wide frequency range for accurate operation at the higher frequency.

The coupler is fabricated by the milling of channels within the surface of a metallic plate, typically aluminum. The channels are provided with a square cross-section, and channels being closed off by a cover plate which mates with the base plate within which the channels have been milled. The coupler has four ports, each port being formed of a coaxial line wherein the center conductor is constructed as a bar of square cross-section which is fabricated of a metal, such as aluminum. The center conductors are located within the channels by dielectric spacers, positioned approximately one-quarter wavelength apart at the mid-band frequency. Coupling the electromagnetic energy from one port to another is accomplished by a window oriented at approximately 45° relative to a port axis. The central conductor joining one pair of ports is brought in close proximity, at the window, to a central conductor joining the other pair of ports. In each of the foregoing pair of ports, the connection of the central conductor is accomplished by a segment of square rod angled at approximately 45° relative to the central conductors of each of the ports in the pair of ports.

In accordance with the invention, improved matching characteristics may be obtained, for example, by notching the interior bend between the bar segment and each of the central conductors in a pair of ports. Spacing between the segments of the central conductors at the window is maintained by a dielectric spacer element in the form of a frame having open spaces so that the major portion of the window is retained as an air or vacuum space. Dielectric retainers contact the central conductors in each pair of ports and clamp the segments at the window against the dielectric spacer to maintain the proper spacing between the transmission lines. The clamping force is obtained by means of a thin-walled metallic cylinder which serves as a spring and which is located in notches machined into the base plate at sites of low electromagnetic field strength. Thereby, the cylindrical springs have no more than a negligible effect on the propagation of electromagnetic energy within the coupler.

In accordance with a feature of the invention, the retainers and the cylindrical springs are readily inserted through the open top portion of the channels. Thus, the central conductor elements, the spaces, the separator, the retainers and the cylindrical springs can all be inserted through the open sides of the channel prior to the closing of the channel with the cover plate. The foregoing arrangement provides a rigid structure in a format wherein the microwave characteristics are readily repeatable with each manufacture of the coupler.

BRIEF DESCRIPTION OF THE DRAWINGS

The foregoing aspects and other features of the invention are explained in the following description taken in connection with the accompanying drawing wherein.

DETAILED DESCRIPTION

Figure 1:
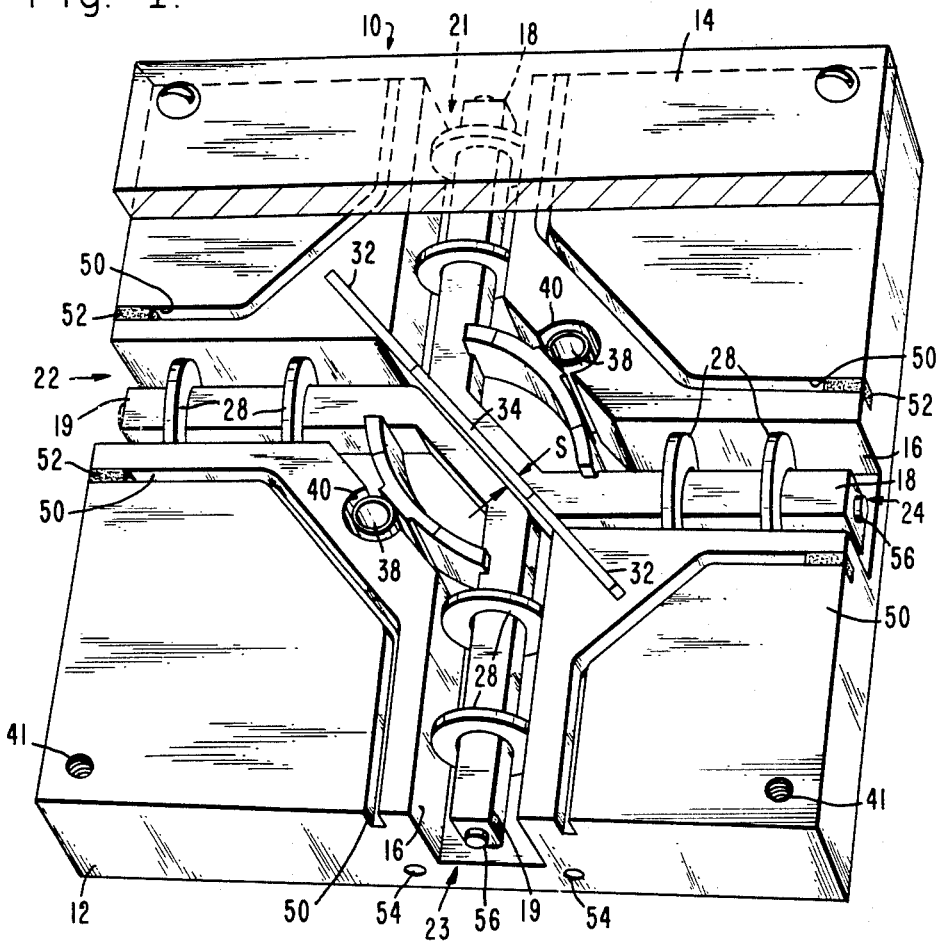
FIG. 1 is a simplified isometric view, partially cut away, showing a hybrid coupler constructed in accordance with the principles of the invention.
Figure 3:
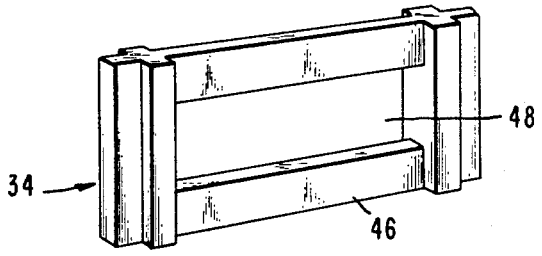
FIG. 3 is an elevation view of a separator shown in FIGS. 1 and 2.
Figure 2:
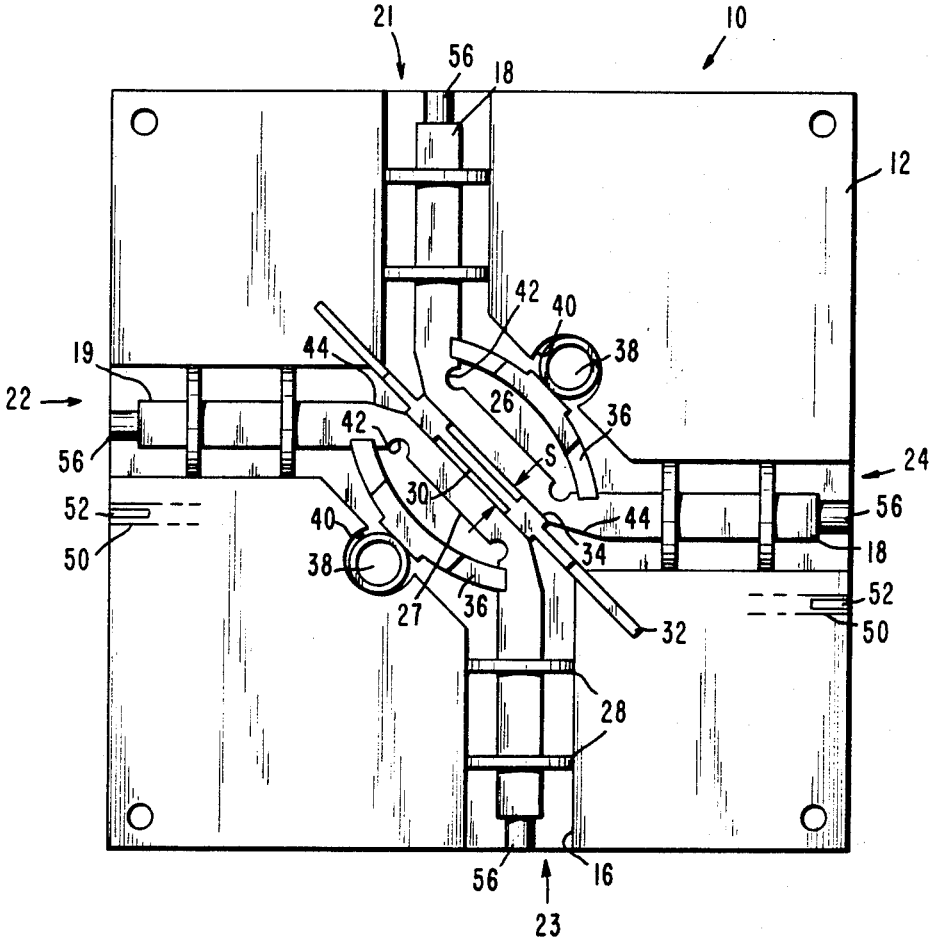
FIG. 2 is a plan view of the hybrid coupler of FIG. 1.

With reference to the figures, a hybrid coupler 10 incorporating the invention is constructed of a base plate 12 and a cover plate 14. Channels 16 are milled into the base plate 12 to form passageways for the transmission of electromagnetic energy. The plates 12 and 14 are constructed of metal, preferably a light-weight metal, such as aluminum, which is also electrically conducting. The channels 16 are provided with a square cross-section, the walls of the channels 16 serving as the outer conductors of coaxial transmission lines. Central conductors 18 and 19 are provided within the channels 16, each of the conductors 18–19 being of square cross-section and being formed of a lightweight electrically conducting material, such as aluminum.

The hybrid coupler 10 has four ports; 21, 22, 23, and 24. Power entering the first port 21 is divided in a desired ratio between the second port 22 and the fourth port 24 where there is essentially no power exiting from the third port 23. An output voltage measure at the second port 22 will lead the corresponding output voltage measured at the fourth port 24 by 90° at all frequencies for which the ports are presented with reflectionless loads. No reflection will appear at these frequencies at the input port 21. As a practical matter in the design of such couplers, actual measured results deviate somewhat from the foregoing ideal situation because of the fact that the cross-sectional dimensions are not negligibly small as compared to a wavelength of the electromagnetic energy.

The coupling of the electromagnetic energy is accomplished by the close proximity of central portions 26 and 27, respectively, of the central conductors 18 and 19, each of the segments 26–27 being in the form of a bar of rectangular cross-section. Positioning of the conductors 18 and 19 within their respective channels 16 is accomplished with the aid of the dielectric spacers 28 positioned along the conductors 18 and 19 with spacings of approximately $\frac{1}{4}$ wavelength of the mid-band frequency.

The coupling of the electromagnetic energy between the segments 26 and 27 is accomplished via a window 30 formed between the bottom of the milled-out region in the base plate 12 and the cover plate 14. The sides of the window 30 terminate in metallic vanes 32 which extend at an approximately 45° angle relative to the axes of the channel 16. The spacing between the ends of the vanes 12, this being the width of the window 30, is selected experimentally and has a length greater than one-quarter wavelength of the mid-band frequency. The spacing S between the segments 26 and 27 is accurately maintained by a separator 34 formed as a frame of dielectric material with substantial air spaces between the members of the frame so as to provide for a substantial air dielectric between the segments 26 and 27.

The segments 26 and 27 are clamped against the separator 34 by dielectric retainers 36 having an arcuate shape for contacting the portions of the conductors 18–19 adjacent the ends of the segments 26–27. Springs 38 are fashioned in the form of thin-walled metallic cylinders pressed against the retainers 36 to position them against the segments 26–27. The springs 38 are located within notches 40 which are milled from the base plate 12 in the corner regions between the pair of channels 16 of the ports 21 and 24 and the pair of channels 16 of the ports 22 and 23.

In accordance with a feature of the invention, the manufacture of the springs 38 of electrically conducting material and the siting of the springs 38 at a distance from the separator 34 and enclosed within the metallic walls of the notches 40 provides for the exertion of force against the segments 26–27 without any significant alteration of the electromagnetic field propagating through the channel 16. The parallel walls of the notches 40, in combination with the cylindrical walls of the springs 38, permit the springs 38 to be readily inserted within the notches 40 at the time of assembly of the coupler 10. The retainers 36, the separator 34 and the conductors 18 and 19 with the spacers 28 thereon are readily inserted, in a similar fashion, into the opened channels 16. After the insertion of the foregoing components to the milled-out regions of the base plate 12, the cover plate 14 is then secured by screws in threaded holes 41 at the corners of the plates 12 and 14.

Further, in accordance with the invention, notches 42 are provided in the bends in the conductors 18 and 19 at the ends of the segments 26–27, the notches 42 being on the interior portions of the bends. The notches provide for a tuning of the coupler 10 so as to provide a suitable impedance match over a band centered at the same portion of the spectral band as the greatest coupling of energy through the window 30. In the case of a frequency band extending from 4–6 GHz, the greatest coupling and a suitably matched impedance occurs over the frequency band. Also, a miter 44 is provided on the exterior portions of the foregoing bends at the termini of the segments 26–27 to further improve the foregoing matching and coupling characteristics. The coupling through the window 30 occurs primarily in the region of air or vacuum dielectric as is provided by a frame 46 in the separator 34 and the openings 48 therein, which provide for the air or vacuum space. The members of the frame 46 are sufficiently rigid to withstand the forces of the springs 38. Thereby, the positions of the conductors 18–19 are rigidly maintained.

To insure the integrity of the coupler 10 with respect to leakage of electromagnetic energy therefrom, grooves 50 are advantageously provided a short distance, typically 1/16 inch, back from the edges of the channels 16. The grooves 15 are milled into the base plate 12. Gaskets 52 of a rubber material containing metallic particles are placed within the grooves 50 prior to the closing of the cover plate 14. Pressure between the plates 12 and 14 compresses the gaskets 52 so as to provide a conducting path between the plates 12 and 14. This conducting path acts as a short circuit to electromagnetic energy and thereby prevents leakage of such energy from the coupler 10.

With respect to the physical size of the channels 16 and the conductors 18–19, the cross-section of the channels 16 bears a ratio of 5:2 relative to the cross-section of the conductor 18 or 19. Thus, by way of example, in the case of a coupler tuned to operate at 4 GHz, the other conductor of the coaxial line, namely the walls of the channel 16, are 0.5 inch square, while the cross-sectional dimensions of the conductor 18 or 19 is 0.2 inches square. At a frequency of approximately 10 GHz, the foregoing example dimensions are cut in half so that the cross-section of a channel 16 measures 0.25 inches square and the cross-sectional dimension of the conductor 18 or 19 measures 0.1 inches square.

The spacing between the segments 26–27 is on the order of 20–30 thousandths inch depending on frequency and on the amount of coupling desired. Coupling ratios in the preferred embodiment are in the range of 3 dB to 12 dB (decibels). The spacing between the vanes 32 measures approximately 0.8 inches. The coupler 10 also accommodates coaxial connectors (not shown) which are secured by screws placed in apertures 54 located within both of the plates 12 and 14 at the sites of the ports 21–24.

A center conductor of the coaxial connector makes contact within a portion of a conductor 18–19 by means of a button 56 having a diameter approximately 0.12 inches and a length of approximately 0.05 inches. The buttons 56 serve as matching structure for minimizing reflection of electromagnetic waves from the coaxial connectors and circuitry connected thereto. Such connectors are to be utilized at the terminals 22 and 24, while a dummy load (not shown) is to be connected at the port 23. The ports 21 serves as an input port. Thereby, in accordance with the preceding details of construction, a hybrid coupler has been disclosed which provides improved impedance matching and relatively constant coupling in both amplitude and phase over a wide spectral band, while maintaining ease of construction and having adequate rigidity to withstand the vibrational and other forces associated with a satellite.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. The microwave coupler comprising:

(a) a set of ports, each of said ports being formed of coaxial transmission lines having inner and outer conductors of rectangular shape cross-section;

(b) pairs of said ports being joined by transmission line segments having inner and outer conductors;

(c) a dielectric frame located between said inner conductors of said transmission line segments for separating said inner conductors by a fixed distance preselected to permit coupling of microwave energy between said segments;

(d) at least one electrically conductive spring disposed in an outer conductor of at least one of said line segments at a site of minimal electric field strength; and (e) means connecting said at least one spring with the inner conductor of one of said line segments for urging together said inner conductors of said line segments against said dielectric frame for maintaining said distance.

2. A coupler according to claim 1 wherein said spring is constructed as a thin-walled cylinder disposed within a cylindrical notch located between a pair of said ports.

3. A coupler according to claim 2 wherein said rectangular cross-sections are square.

4. A coupler according to claim 3 wherein there are two sets of ports, each set having two ports, said dielectric frame being disposed diagonally relative to said ports, said dielectric frame having an opening therein defining an air dielectric.

5. A coupler according to claim 4 including a pair of vanes disposed on said dielectric frame at opposite sides of said opening, the length of said opening between said vanes being between one-quarter and one-half wavelength of the radiant energy transmitted via said coupler at a mid-portion of the spectral region of said radiant energy.

6. A coupler according to claim 5 wherein said coupler is a hybrid coupler and the center conductors of said ports are terminated with impedance matching buttons.

7. A coupler according to claim 5 wherein said connecting means are formed of dielectric material, and wherein said separating means is formed of a dielectric frame defining an open region providing an air dielectric.

8. A coupler according to claim 1 wherein said dielectric frame is oriented diagonally with respect to axes of said ports, inner conductors of said line segments are oriented diagonally to said axes of said ports and in parallel with said dielectric frame, there being an outer bend at the junction of the inner conductor of each said line segment and a respective port, an outer curve of said bend being mitered and an inner curve of said bend being notched to provide an impedance match over a spectral portion of transmission of radiant energy coinciding with a spectral portion of the coupling of radiant energy via said dielectric frame.

9. A coupler according to claim 8 further comprising notches formed within the outer conductor of said transmission line segments, and wherein said at least one spring is formed of a thin-walled cylinder disposed within at least one of said notches, there being an opening disposed within said dielectric frame, and wherein said coupler further comprises vanes disposed along the opposite sides of said opening to provide a distance between said vanes of approximately one-quarter to one-half wavelength of the radiant energy to permit said coupler to function as a hybrid coupler.

* * * * *